US010192523B2

(12) United States Patent
Luomala et al.

(10) Patent No.: US 10,192,523 B2
(45) Date of Patent: Jan. 29, 2019

(54) METHOD AND APPARATUS FOR PROVIDING AN OVERVIEW OF A PLURALITY OF HOME SCREENS

(75) Inventors: Petri Luomala, Oulu (FI); Janne V. Kyllonen, Haukipudas (FI); Jari Lahdenpera, Kempele (FI); Markku Rytivaara, Oulo (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 354 days.

(21) Appl. No.: 13/250,286

(22) Filed: Sep. 30, 2011

(65) Prior Publication Data

US 2013/0083075 A1 Apr. 4, 2013

(51) Int. Cl.
*G09G 5/00* (2006.01)
*G09G 5/14* (2006.01)

(52) U.S. Cl.
CPC ..... *G09G 5/14* (2013.01); *G09G 2340/045* (2013.01); *G09G 2340/0464* (2013.01); *G09G 2340/145* (2013.01)

(58) Field of Classification Search
CPC ..... G06F 2203/04803; G06F 9/4443; G06T 19/20; G06T 2219/2004
USPC ..... 345/660–689
See application file for complete search history.

(56) References Cited

U.S. PATENT DOCUMENTS 7,940,250 B2 * 5/2011 Forstall ..... 345/173
2008/0034309 A1 * 2/2008 Louch et al. ..... 715/766
2008/0235602 A1 * 9/2008 Strauss et al. ..... 715/762
2009/0013275 A1 * 1/2009 May et al. ..... 715/765
2009/0113330 A1 * 4/2009 Garrison et al. ..... 715/769
2009/0187840 A1 * 7/2009 Moosavi ..... 715/767
2010/0138295 A1 * 6/2010 Caron et al. ..... 705/14.49
(Continued)

FOREIGN PATENT DOCUMENTS

EP 2 194 452 A1 6/2010
EP 2 439 915 A1 4/2012
(Continued)

OTHER PUBLICATIONS

"HTC Sense on Android 2.1 enable pinch-to-zoom on home screen"; Available at http://htcsource.com/2010/02/video-htc-sense-on-android-2-1-enable-pinch-to-zoom-on-home-screen/; May 11, 2012.
(Continued)

*Primary Examiner* — Charles Tseng
(74) *Attorney, Agent, or Firm* — Alston & Bird LLP

(57) ABSTRACT

A method, apparatus and computer program product are provided that facilitate an overview of a plurality of home screens in order to increase the efficiency with which users interact with the home screens. In this regard, a method is provided that includes causing a display of a first home screen and then causing the display to zoom out from the first home screen to a canvas overview representing a plurality of home screens including the first home screen. The canvas overview is configured to present the plurality of home screens in a continuous arrangement and to group items accessible via a respective home screen in proximity to one another. The method also receives a selection of a second home screen from the canvas overview and causes the display to be zoomed in from the canvas overview to the second home screen.

15 Claims, 7 Drawing Sheets

(56) References Cited

U.S. PATENT DOCUMENTS

| | | | | |
|---|---|---|---|---|
| 2010/0223563 | A1 | 9/2010 | Green | |
| 2010/0295789 | A1* | 11/2010 | Shin et al. | 345/168 |
| 2011/0090155 | A1* | 4/2011 | Caskey et al. | 345/173 |
| 2011/0185317 | A1* | 7/2011 | Thimbleby et al. | 715/863 |
| 2011/0193857 | A1* | 8/2011 | Filippov et al. | 345/419 |
| 2011/0252346 | A1* | 10/2011 | Chaudhri | 715/765 |
| 2012/0023425 | A1* | 1/2012 | Hackborn et al. | 715/768 |
| 2012/0081356 | A1* | 4/2012 | Filippov et al. | 345/419 |
| 2012/0159401 | A1* | 6/2012 | Pahud et al. | 715/863 |
| 2012/0242599 | A1* | 9/2012 | Seo et al. | 345/173 |
| 2012/0278722 | A1* | 11/2012 | Raleigh et al. | 715/735 |
| 2012/0284620 | A1* | 11/2012 | Yach et al. | 715/716 |
| 2012/0284658 | A1* | 11/2012 | Hirvonen | 715/779 |
| 2012/0289147 | A1* | 11/2012 | Raleigh et al. | 455/3.06 |
| 2013/0027612 | A1* | 1/2013 | Miloseski et al. | 348/552 |
| 2013/0054720 | A1* | 2/2013 | Kang et al. | 709/206 |
| 2013/0103665 | A1* | 4/2013 | Kasterstein et al. | 707/706 |

FOREIGN PATENT DOCUMENTS

| | | | |
|---|---|---|---|
| WO | WO 2010/061042 | A1 | 6/2010 |
| WO | WO 2010/134718 | A1 | 11/2010 |

OTHER PUBLICATIONS

"Visual Task Switcher Free" by ESD Mobile; AppBrain Android Market; Downloaded on May 9, 2012 at http://www.appbrain.com/app/visual-task-switcher-free/com.esdmobile.taskswitcher.

"HTC Evo 4G"; Available at http://www.htc.com/us/support/htc-evo-3d-sprint/help/faqs?faqtype=gtpmuchj; May 11, 2012.

"iPhone 4 Made Simple"; Available at http://books.google.co.in/books?hl—en&lr=&id=1OxSC1dL3YMC&oi=fnd&pg=PP1&dq=Homescreens+overview+with+task+switching&ots=F0L1GyjYpb&sig=IMb6pKkkc3ZT6P-aIHGmptCJnR8#v=onepage&q&f=false; May 11, 2012.

"Fedora 12 Multiple Desktop Wallpapers (KDE)"; Available at http://www.youtube.com/watch?v=uoTgVk2ZEqE; May 11, 2012.

* cited by examiner

METHOD AND APPARATUS FOR PROVIDING AN OVERVIEW OF A PLURALITY OF HOME SCREENS

TECHNOLOGICAL FIELD

An example embodiment to the present invention relates generally to the home screen that may include items, such as icons, representative of, for example, applications, widgets, shortcuts or the like and, more particularly, to a method, apparatus and computer program product for providing an overview of a plurality of home screens.

BACKGROUND

Computing devices, such as mobile terminals, personal computers or the like, may support a plurality of home screens. Each home screen may include one or more items, such as icons, that are selectable by a user in order to launch an application, access content or otherwise perform a function represented by the item. In this regard, items, such as icons, may represent, for example, applications, widgets, shortcuts, various types of content or the like. For at least some of the home screens, the plurality of items may be related in some fashion, such as by being related by subject matter, by frequency of use, etc. For example, a first home screen may include items associated with a user's work environment and a second home screen may include items associated with a user's home environment. While some of the home screens may share some of the same items, each home screen generally includes a combination of items that are different than the other home screens.

Because of the plurality of home screens, a user may find it challenging or at least time consuming to manage each of the home screens, such as to insure that each home screen includes the items appropriate for the respective home screen. In this regard, it may be impossible or at least difficult to move one or more items from one home screen to another in an effort to reconfigure a home screen. Additionally, the user may also find the creation of a new and additional home screen to be a time consuming process. In this regard, a new home screen may be created by presenting a user with a blank screen and then permitting the user to populate the screen with various items. However, the selection of the various items and the placement of the items in the newly created home screen may prove to be somewhat inefficient.

BRIEF SUMMARY

A method, apparatus and computer program product are provided in accordance with an example embodiment of the present invention for providing an overview of a plurality of home screens. Based upon the overview of the plurality of home screens, a user may readily select another home screen for display, thereby facilitating switching between home screens. The overview of the plurality of home screens may also permit a user to more efficiently manage the home screens, such as by moving or copying items from one home screen to another home screen and, in one embodiment, may facilitate the creation of a new home screen based upon the movement or copying of items from one or more of the existing home screens to the new home screen. Still further, the overview of the plurality of home screens may, in one embodiment, facilitate task switching between applications or other tasks represented by corresponding items on the plurality of home screens. As such, the method, apparatus and computer program product of an example embodiment may increase the efficiency with which a user interacts with a plurality of home screens by providing an overview of the plurality of home screens.

In one embodiment, a method is provided that includes causing a display of a first home screen and then causing, with a processor, the display to zoom out from the first home screen to a canvas overview representing a plurality of home screens including the first home screen. The canvas overview is configured to present the plurality of home screens in a continuous arrangement and to group items accessible via a respective home screen in proximity to one another. The method also receives a selection of a second home screen from the canvas overview and causes the display to be zoomed in from the canvas overview to the second home screen.

The method of one embodiment may cause an item to be moved from one home screen to another home screen while the canvas overview is caused to be displayed. The method of another embodiment may cause an item to be moved from one home screen to another portion of the canvas overview in order to newly define a different home screen. Additionally or alternatively, the method may cause a representation of each application that is active to be displayed in a respective area of the canvas overview. The method of one embodiment may cause an application to be launched in response to user input while the canvas overview is caused to be displayed. The method of another embodiment may cause a representation of each item representative of a shortcut to be displayed in a respective area of the canvas overview. Additionally or alternatively, the method may cause an application library to be displayed in a respective area of the canvas overview.

In another embodiment, an apparatus is provided that includes at least one processor and at least one memory storing computer program code with the at least one memory and stored computer program code being configured, with the at least one processor, to cause the apparatus to at least cause a display of a first home screen and to cause the display to zoom out from the first home screen to a canvas overview representing a plurality of home screens including the first home screen. The canvas overview is configured to present the plurality of home screens in a continuous arrangement and to group items accessible via a respective home screen in proximity to one another. The at least one memory and stored computer program code are also configured, with the at least one processor, to cause the apparatus to receive a selection of a second home screen from the canvas overview and to cause the display to be zoomed in from the canvas overview to the second home screen.

The at least one memory and stored computer program code may be further configured, with the at least one processor, to cause the apparatus of one embodiment to cause an item to be moved from one home screen to another home screen while the canvas overview is caused to be displayed. The at least one memory and stored computer program code may be further configured, with the at least one processor, to cause the apparatus of another embodiment to cause an item to be moved from one home screen to another portion of the canvas overview in order to newly define a different home screen. Additionally or alternatively, the at least one memory and stored computer program code may be further configured, with the at least one processor, to cause the apparatus to cause a representation of each application that is active to be displayed in a respective area of the canvas overview. The at least one memory and stored computer program code may be further configured, with the at least one processor, to cause the apparatus of one embodiment to cause an application to be launched in response to user input while the canvas overview is caused to be displayed. The at least one memory and stored computer program code may be further configured, with the at least one processor, to cause the apparatus of another embodiment to cause a representation of each item representative of a shortcut to be displayed in a respective area of the canvas overview. Additionally or alternatively, the at least one memory and stored computer program code may be further configured, with the at least one processor, to cause the apparatus to cause an application library to be displayed in a respective area of the canvas overview.

In a further embodiment, a computer program product is provided that includes at least one non-transitory computer-readable storage medium having computer-readable program instructions stored therein with the computer-readable program instructions including program instructions configured to cause a display of a first home screen and program instructions configured to cause the display to zoom out from the first home screen to a canvas overview representing a plurality of home screens including the first home screen. The canvas overview is configured to present the plurality of home screens in a continuous arrangement and to group items accessible via a respective home screen in proximity to one another. The computer-readable program instructions also include program instructions configured to receive a selection of a second home screen from the canvas overview and program instructions configured to cause the display to be zoomed in from the canvas overview to the second home screen.

The computer-readable program instructions of one embodiment may also include program instructions configured to cause an item to be moved from one home screen to another home screen while the canvas overview is caused to be displayed. The computer-readable program instructions of another embodiment may also include program instructions configured to cause an item to be moved from one home screen to another portion of the canvas overview in order to newly define a different home screen. Additionally or alternatively, the computer-readable program instructions may program instructions configured to cause a representation of each application that is active to be displayed in a respective area of the canvas overview. The computer-readable program instructions of one embodiment may also include comprise program instructions configured to cause a representation of each item representative of a shortcut to be displayed in a respective area of the canvas overview. The computer-readable program instructions of another embodiment may also include program instructions configured to cause an application library to be displayed in a respective area of the canvas overview.

In yet another embodiment, an apparatus is provided that includes means for causing a display of a first home screen and means for causing the display to zoom out from the first home screen to a canvas overview representing a plurality of home screens including the first home screen. The canvas overview is configured to present the plurality of home screens in a continuous arrangement and to group items accessible via a respective home screen in proximity to one another. The apparatus of this embodiment also includes means for receiving a selection of a second home screen from the canvas overview and means for causing the display to be zoomed in from the canvas overview to the second home screen.

BRIEF DESCRIPTION OF THE DRAWINGS

Figure 1:
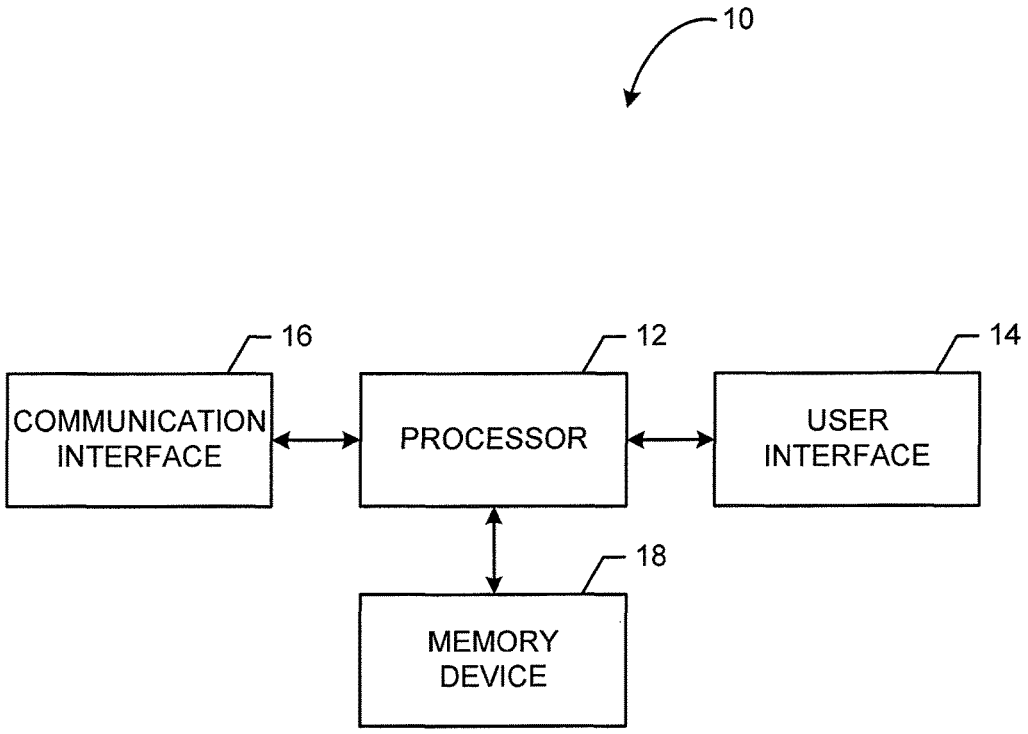
Figure 2:
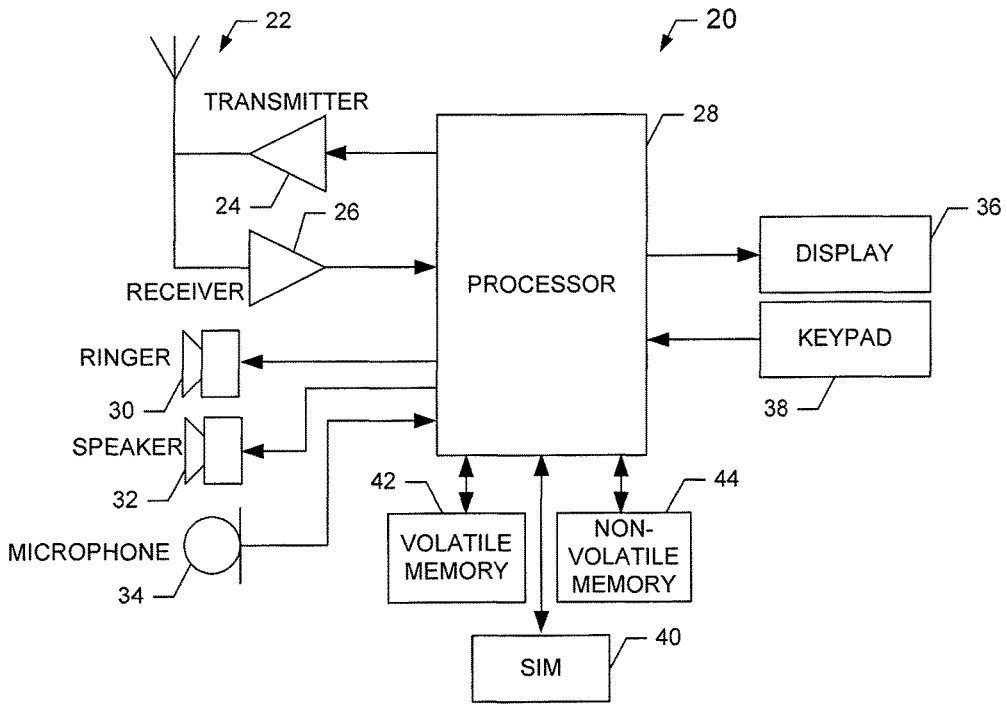
Figure 3:
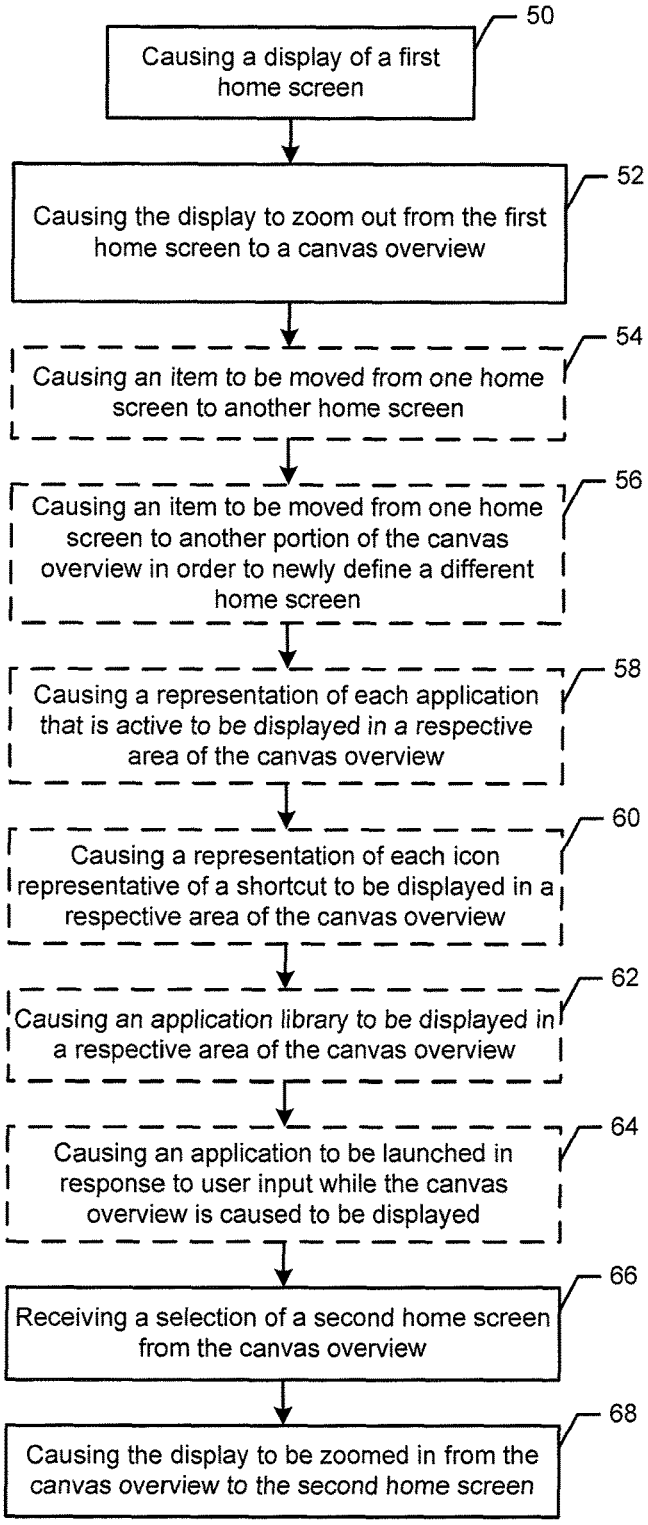
Figure 4:
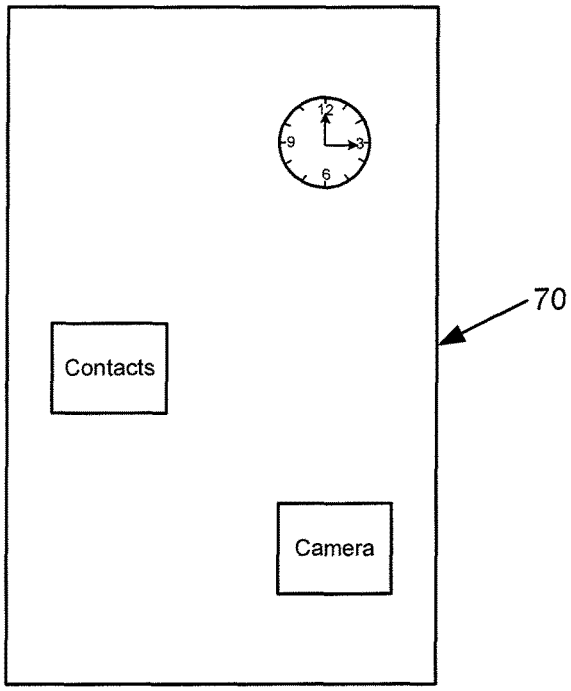
Figure 5:
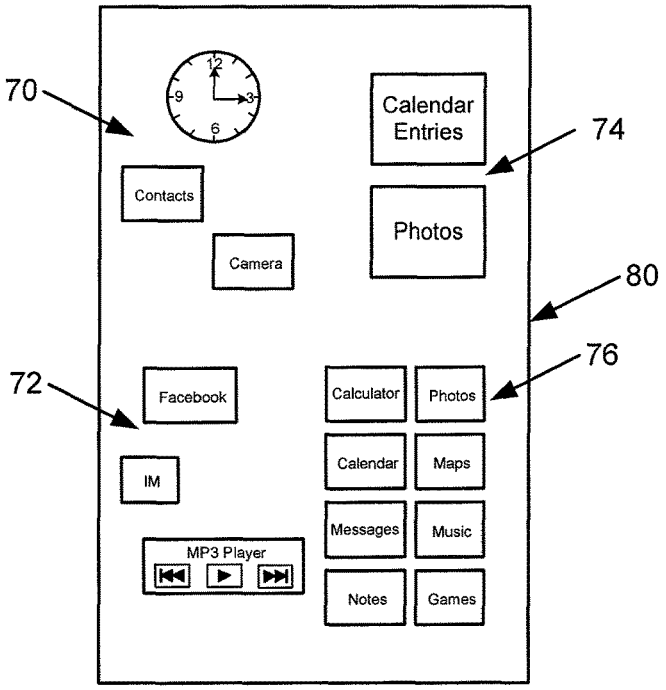
Figure 6:
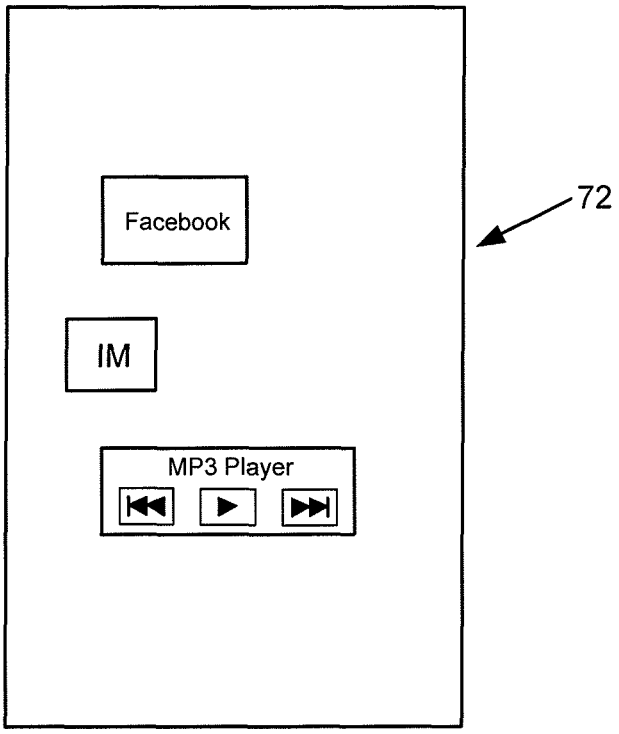
Figure 7:
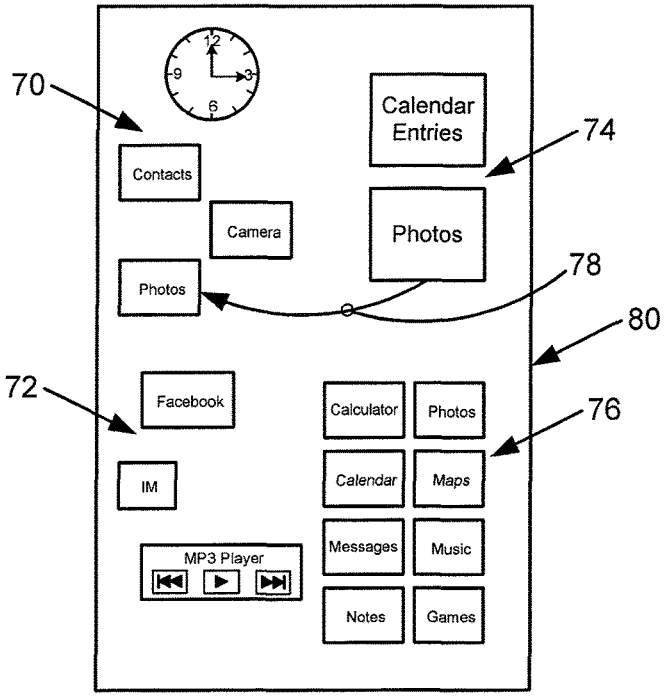
Figure 8:
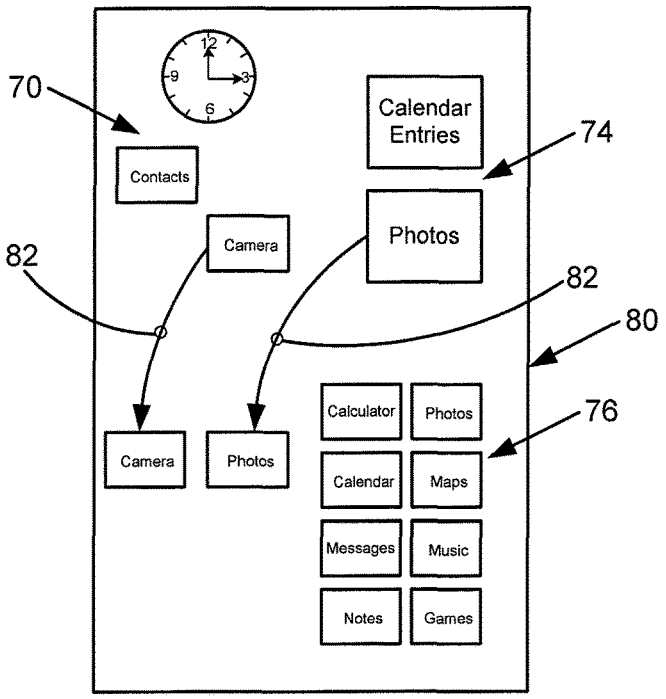
Figure 9:
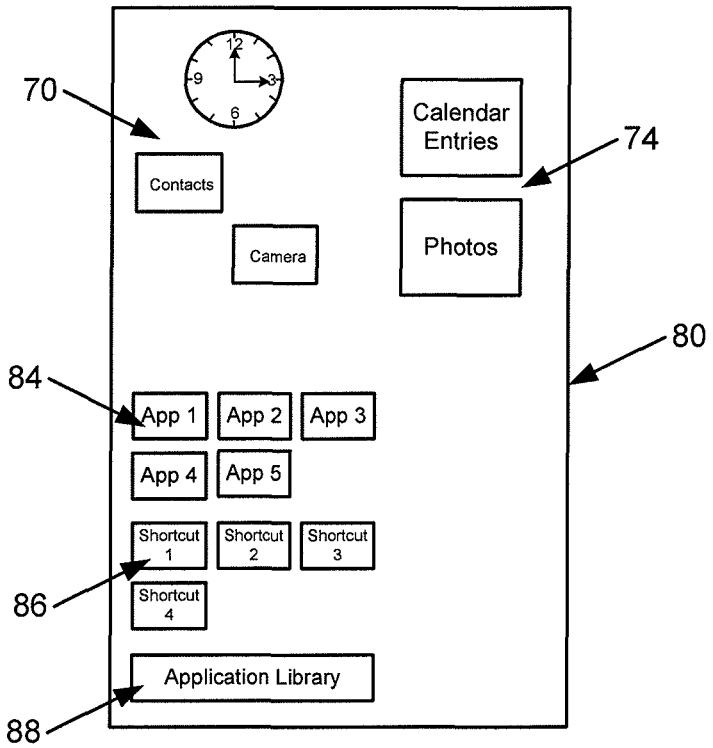

Having thus described some example embodiments of the present invention in general terms, reference will hereinafter be made to the accompanying drawings, which are not necessarily drawn to scale, and wherein:

FIG. 1 is a block diagram of an apparatus that may be specifically configured in accordance with an example embodiment of the present invention;

FIG. 2 is a block diagram of a mobile terminal that may be specifically configured in accordance with an example embodiment of the present invention;

FIG. 3 is a flowchart illustrating the operations performed according to an example embodiment of the present invention;

FIG. 4 is a representation of a first home screen;

FIG. 5 is a representation of a canvas overview that may be provided in accordance with an example embodiment of the present invention;

FIG. 6 is a second home screen that may be displayed in response to a selection from the canvas overview in accordance with an example embodiment of the present invention;

FIG. 7 is a representation of a canvas overview that illustrates movement of an item between home screens in accordance with an example embodiment of the present invention;

FIG. 8 is a representation of a canvas overview that illustrates the generation of a new home screen in accordance with an example embodiment of the present invention; and FIG. 9 is a representation of a canvas overview that has respective portions designated to display items, such as icons associated with active applications, shortcuts and the like, as well as a link to an application library in accordance with an example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory or physical storage medium (e.g., volatile or non-volatile memory device), can be differentiated from a "computer-readable transmission medium," which refers to an electromagnetic signal.

As described below, a method, apparatus and computer program product are provided that permit an overview of a plurality of home screens to be provided to facilitate the interaction of a user with the home screens, such as to manage the home screens, modify the home screens, create a new home screen or the like. The home screens may be generated by and presented upon the display of a variety of different computing devices. In this regard, a computing device that may generate and present an overview of the plurality of home screens in accordance with an example embodiment of the present invention may consist of or include an apparatus, such as shown in FIG. 1, and, in one embodiment, may be a mobile terminal, such as shown in FIG. 2. While the apparatus of FIG. 1 may be embodied in a mobile terminal, such as shown in FIG. 2 and described below, it should be noted that the apparatus of FIG. 1 may also be embodied in a variety of other devices, both mobile and fixed, and therefore embodiments of the present invention should not be limited to application on devices such as the mobile terminal of FIG. 2. For example, the apparatus may be employed on a personal computer or other user terminal.

It should also be noted that while FIG. 1 illustrates one example of a configuration of an apparatus 10 for providing an overview of a plurality of home screens and for facilitating user management of the home screens, numerous other configurations may also be used to implement embodiments of the present invention. As such, in some embodiments, although devices or elements are shown as being in communication with each other, hereinafter such devices or elements should be considered to be capable of being embodied within a same device or element and thus, devices or elements shown in communication should be understood to alternatively be portions of the same device or element.

Referring now to FIG. 1, the apparatus 10 for providing an overview of a plurality of home screens may include or otherwise be in communication with a processor 12, a communication interface 16, a memory device 18 and optionally a user interface 14. In some embodiments, the processor 12 (and/or co-processors or any other processing circuitry assisting or otherwise associated with the processor) may be in communication with the memory device 18 via a bus for passing information among components of the apparatus 10. The memory device 18 may include, for example, one or more volatile and/or non-volatile memories. In other words, for example, the memory device 18 may be an electronic storage device (e.g., a computer readable storage medium) comprising gates configured to store data (e.g., bits) that may be retrievable by a machine (e.g., a computing device like the processor 12). The memory device 18 may be configured to store information, data, content, applications, instructions, or the like for enabling the apparatus to carry out various functions in accordance with an example embodiment of the present invention. For example, the memory device 18 could be configured to buffer input data for processing by the processor 12. Additionally or alternatively, the memory device 18 could be configured to store instructions for execution by the processor 12.

The apparatus 10 may, in some embodiments, be a user terminal (e.g., mobile terminal 20) or a fixed communication device or computing device configured to employ an example embodiment of the present invention. However, in some embodiments, the apparatus 10 or at least components of the apparatus, such as the processor 12, may be embodied as a chip or chip set. In other words, the apparatus 10 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus 10 may therefore, in some cases, be configured to implement an embodiment of the present invention on a single chip or as a single "system on a chip." As such, in some cases, a chip or chipset may constitute means for performing one or more operations for providing the functionalities described herein.

The processor 12 may be embodied in a number of different ways. For example, the processor 12 may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor 12 may include one or more processing cores configured to perform independently. A multi-core processor may enable multiprocessing within a single physical package. Additionally or alternatively, the processor 12 may include one or more processors configured in tandem via the bus to enable independent execution of instructions, pipelining and/or multithreading.

In an example embodiment, the processor 12 may be configured to execute instructions stored in the memory device 18 or otherwise accessible to the processor. Alternatively or additionally, the processor 12 may be configured to execute hard coded functionality. As such, whether configured by hardware or software methods, or by a combination thereof, the processor 12 may represent an entity (e.g., physically embodied in circuitry) capable of performing operations according to an embodiment of the present invention while configured accordingly. Thus, for example, when the processor 12 is embodied as an ASIC, FPGA or the like, the processor may be specifically configured hardware for conducting the operations described herein. Alternatively, as another example, when the processor 12 is embodied as an executor of software instructions, the instructions may specifically configure the processor 12 to perform the algorithms and/or operations described herein when the instructions are executed. However, in some cases, the processor 12 may be a processor of a specific device (e.g., a mobile terminal) configured to employ an embodiment of the present invention by further configuration of the processor 12 by instructions for performing the algorithms and/or operations described herein. The processor 12 may include, among other things, a clock, an arithmetic logic unit (ALU) and logic gates configured to support operation of the processor.

Meanwhile, the communication interface 16 may be any means such as a device or circuitry embodied in either hardware or a combination of hardware and software that is configured to receive and/or transmit data from/to a network and/or any other device or module in communication with the apparatus 10. In this regard, the communication interface 16 may include, for example, an antenna (or multiple antennas) and supporting hardware and/or software for enabling communications with a wireless communication network. Additionally or alternatively, the communication interface 16 may include the circuitry for interacting with the antenna(s) to cause transmission of signals via the antenna(s) or to handle receipt of signals received via the antenna(s). In some environments, the communication interface 16 may alternatively or also support wired communication. As such, for example, the communication interface 16 may include a communication modem and/or other hardware/software for supporting communication via cable, digital subscriber line (DSL), universal serial bus (USB) or other mechanisms.

In some embodiments, such as instances in which the apparatus 10 is embodied by a user device, the apparatus may include a user interface 14 that may, in turn, be in communication with the processor 12 to receive an indication of a user input and/or to cause provision of an audible, visual, mechanical or other output to the user. As such, the user interface 14 may include, for example, a keyboard, a mouse, a joystick, a display, a touch screen(s), touch areas, soft keys, a microphone, a speaker, or other input/output mechanisms. Alternatively or additionally, the processor 12 may comprise user interface circuitry configured to control at least some functions of one or more user interface elements such as, for example, a speaker, ringer, microphone, display, and/or the like. The processor 12 and/or user interface circuitry comprising the processor may be configured to control one or more functions of one or more user interface elements through computer program instructions (e.g., software and/or firmware) stored on a memory accessible to the processor (e.g., memory device 18, and/or the like). In other embodiments, however, the apparatus 10 may not include a user interface 14.

Turning now to FIG. 2, a block diagram of a mobile terminal 20 that may embody the apparatus 10 of FIG. 1 and that would benefit from embodiments of the present invention is illustrated. It should be understood, however, that the mobile terminal 20 as illustrated and hereinafter described is merely illustrative of one type of user device that may benefit from embodiments of the present invention and, therefore, should not be taken to limit the scope of embodiments of the present invention. As such, although numerous types of mobile terminals, such as portable digital assistants (PDAs), mobile telephones, pagers, mobile televisions, gaming devices, laptop computers, cameras, tablet computers, touch surfaces, wearable devices, video recorders, audio/video players, radios, electronic books, positioning devices (e.g., global positioning system (GPS) devices), or any combination of the aforementioned, and other types of voice and text communications systems, may readily employ embodiments of the present invention, other user devices including fixed (non-mobile) electronic devices may also employ some example embodiments.

The mobile terminal 20 may include an antenna 22 (or multiple antennas) in operable communication with a transmitter 24 and a receiver 26 with the combination thereof comprising the communication interface 16 of the apparatus 10 of FIG. 1 in one embodiment. The mobile terminal 20 may further include an apparatus, such as a processor 28 or other processing device (e.g., processor 12 of the apparatus 10 of FIG. 1), which controls the provision of signals to and the receipt of signals from the transmitter 24 and receiver 26, respectively. The signals may include signaling information in accordance with the air interface standard of the applicable cellular system, and also user speech, received data and/or user generated data. In this regard, the mobile terminal 20 is capable of operating with one or more air interface standards, communication protocols, modulation types, and access types. By way of illustration, the mobile terminal 20 is capable of operating in accordance with any of a number of first, second, third and/or fourth-generation communication protocols or the like. For example, the mobile terminal 20 may be capable of operating in accordance with second-generation (2G) wireless communication protocols IS-136 (time division multiple access (TDMA)), GSM (global system for mobile communication), and IS-95 (code division multiple access (CDMA)), or with third-generation (3G) wireless communication protocols, such as Universal Mobile Telecommunications System (UMTS), CDMA2000, wideband CDMA (WCDMA) and time division-synchronous CDMA (TD-SCDMA), with 3.9G wireless communication protocol such as evolved UMTS Terrestrial Radio Access Network (E-UTRAN), with fourth-generation (4G) wireless communication protocols (e.g., Long Term Evolution (LTE) or LTE-Advanced (LTE-A) or the like. As an alternative (or additionally), the mobile terminal 20 may be capable of operating in accordance with non-cellular communication mechanisms. For example, the mobile terminal 20 may be capable of communication in a wireless local area network (WLAN) or other communication networks.

In some embodiments, the processor 28 may include circuitry desirable for implementing audio and logic functions of the mobile terminal 20. For example, the processor 28 may be comprised of a digital signal processor device, a microprocessor device, and various analog to digital converters, digital to analog converters, and other support circuits. Control and signal processing functions of the mobile terminal 20 are allocated between these devices according to their respective capabilities. The processor 28 thus may also include the functionality to convolutionally encode and interleave message and data prior to modulation and transmission. The processor 28 may additionally include an internal voice coder, and may include an internal data modem. Further, the processor 28 may include functionality to operate one or more software programs, which may be stored in memory. For example, the processor 28 may be capable of operating a connectivity program, such as a conventional Web browser. The connectivity program may then allow the mobile terminal 20 to transmit and receive Web content, such as location-based content and/or other web page content, according to a Wireless Application Protocol (WAP), Hypertext Transfer Protocol (HTTP) and/or the like, for example.

The mobile terminal 20 may also comprise a user interface, such as user interface 14 of the apparatus 10 of FIG. 1, including an output device such as a conventional earphone or speaker 32, a ringer 30, a microphone 34, a display 36, and a user input interface, all of which are coupled to the processor 28. The user input interface, which allows the mobile terminal 20 to receive data, may include any of a number of devices allowing the mobile terminal to receive data, such as a keypad 38, a touch screen display (display 36 providing an example of such a touch screen display) or other input device. In embodiments including the keypad 38, the keypad may include the conventional numeric (0-9) and related keys (#, *), and other hard and soft keys used for operating the mobile terminal 20. Alternatively or additionally, the keypad 38 may include a conventional QWERTY keypad arrangement. The keypad 38 may also include various soft keys with associated functions. In addition, or alternatively, the mobile terminal 20 may include an interface device such as a joystick or other user input interface. Some embodiments employing a touch screen display, as described further below, may omit the keypad 38 and any or all of the speaker 32, ringer 30 and microphone 34 entirely. The mobile terminal 20 further includes a battery (not shown), such as a vibrating battery pack, for powering various circuits that are required to operate the mobile terminal, as well as optionally providing mechanical vibration as a detectable output.

The mobile terminal 20 may further include a user identity module (UIM) 40. The UIM 40 is typically a memory device having a processor built in. The UIM 40 may include, for example, a subscriber identity module (SIM), a universal integrated circuit card (UICC), a universal subscriber identity module (USIM), a removable user identity module (R-UIM), a virtual user identity module, etc. The UIM 40 typically stores information elements related to a mobile subscriber. In addition to the UIM 40, the mobile terminal 20 may be equipped with memory. For example, the mobile terminal 20 may include volatile memory 42, such as volatile random access memory (RAM) including a cache area for the temporary storage of data. The mobile terminal 20 may also include other non-volatile memory 44, which may be embedded and/or may be removable. The memories may store any of a number of pieces of information, and data, used by the mobile terminal 20 to implement the functions of the mobile terminal. For example, the volatile memory 42 and/or the non-volatile memory 44 may comprise the memory device 18 of the apparatus 10 of FIG. 1.

In accordance with an example embodiment, an apparatus, such as the apparatus 10 and, more particularly, the processor 12 of FIG. 1, and, in one embodiment, a mobile terminal 20, such as the processor 28 of FIG. 2, may be specifically configured in order to provide a user with an overview of a plurality of home screens and to facilitate the management of the home screens by the user. As shown in operation 50 of FIG. 3, an apparatus 10, such as may be embodied by a mobile terminal 20, may be configured to cause a first home screen to be displayed. In this regard, for example, the processor 12 of the apparatus 10 of FIG. 1 or, in the embodiment in which the apparatus is embodied by a mobile terminal 20, the processor 28 of the mobile terminal of FIG. 2 may be configured to cause the display of the first home screen. As shown by way of example in FIG. 4, the first home screen 70 may include one or more items, such as widgets, icons or the like. The icons may, in turn, represent applications, content, functions or the like that may be selected for execution by the user. In regards to the example of FIG. 4, the first home screen 70 includes a clock widget and icons for a contacts application and a camera application.

In accordance with an example embodiment of the present invention and as shown in operation 52 of FIG. 3, the apparatus 10 may also be specifically configured to zoom out from the first home screen to a canvas overview. The canvas overview represents a plurality of home screens including the first home screen. In this regard, the processor 12 of the apparatus 10 may be specifically configured to zoom out from the first home screen to the canvas overview and, in the embodiment in which the apparatus is embodied by the mobile terminal 20, the processor 28 of the mobile terminal may be specifically configured to zoom out from the first home screen to the canvas overview. By way of example, a canvas overview 80 is depicted in FIG. 5 with the canvas overview including a plurality of home screens 70, 72, 74, 76 including the first home screen shown in FIG. 4. The canvas overview 80 is configured to group items that are accessible via a respective home screen in proximity to one another. Thus, the items that are normally included within the first home screen 70 may be grouped together, while the items that are included in other home screens 72, 74, 76 are similarly grouped together.

As will also be noted by reference to FIG. 5, the canvas overview 80 of one embodiment represents a plurality of home screens in a continuous arrangement, that is, the home screens are presented without page separation, e.g., without page indications, between the plurality of home screens. In other words, the canvas overview 80 does not include any visible delineation or demarcation between the plurality of home screens such that the plurality of home screens are disposed in a continuous arrangement relative to one another. Instead, in one embodiment, the canvas overview 80 may be constructed, such as by the processor 12 of the apparatus 10 of FIG. 1, such that blank space, that is, space that is unoccupied by an item from any of the plurality of home screens, is provided between the groupings of items from the different home screens, thereby providing some visual separation between the different home screens represented by the canvas overview even though the home screens remain continuous without page indications being provided therebetween.

As shown in operation 66, the apparatus 10 of one example embodiment is also specifically configured to receive a selection of a second home screen 72 from the canvas overview 80. In one embodiment, the processor 12, user interface 14 or the like of the apparatus 10 of FIG. 1 and, in the embodiment in which the apparatus is embodied by a mobile terminal 20, the processor 28, the keypad 38 or the like of the mobile terminal may be configured to receive a selection of the second home screen 72 from the canvas overview 80. The second home screen 72 may be selected in various manners. In one embodiment, a user may place a cursor upon or otherwise highlight that portion of the canvas overview 80 that represents the second home screen in order to select the second home screen 72. In response to the selection of the second home screen 72, the apparatus 10 may be specifically configured to zoom in from the canvas overview 80 to the second home screen 72 as shown in operation 68 of FIG. 3. In this regard, the processor 12 of the apparatus 10 of FIG. 1 such as, in the embodiment in which the apparatus is embodied by a mobile terminal 20, the processor 28 of the mobile terminal of FIG. 2 may be specifically configured to zoom in from the canvas overview 80 to the second home screen 72 in response to the selection of the second home screen. By way of example, FIG. 6 shows the second home screen 72 that may be presented following selection of the second home screen from the canvas overview 80 of FIG. 5. As shown in the example of FIG. 6, the second home screen 72 includes items, such as icons representative of the Facebook, Instant Messaging (IM) and MP3 player applications. While the second home screen 72 includes a different set of items than those of the other home screens, including the first home screen 70, the home screens may, instead, include one or more items that are unique or different from the other home screens.

In some embodiments, certain ones of the operations above may be modified or further amplified as described below. Moreover, in some embodiments additional optional operations may also be included (some examples of which are shown in dashed lines in FIG. 3). It should be appreciated that each of the modifications, optional additions or amplifications below may be included with the operations above either alone or in combination with any others among the features described herein. In this regard, while the canvas overview 80 is presented, the apparatus 10 may optionally be configured to permit the user to interact with the canvas overview in variety of different manners so as to manage the home screens including a redefinition of one or more of the home screens, the creation of a new home screen or the like. As shown in operation 54 of FIG. 3 and in FIG. 7, the apparatus 10 may be specifically configured to cause an item to be moved from one home screen to another home screen while the canvas overview 80 is displayed. In this regard, the processor 12 of the apparatus 10 of FIG. 1 or, in the embodiment in which the apparatus is embodied by the mobile terminal 20, the processor 28 of the mobile terminal of FIG. 2 may be specifically configured to cause the item to be moved from one home screen to another home screen while the canvas overview 80 is being displayed. The selection and subsequent movement of an item from one home screen to another home screen may be effected in various manners. In one embodiment, however, the apparatus 10, such as the processor 12, may receive a selection of an item of one home screen along with an indication that the item is to be moved to another home screen. For example, a user may place a cursor upon or otherwise highlight an item of one home screen and may then drag the item to another home screen. In this fashion, the item, such as the icon representative of the photos application in FIG. 7, may be moved from one home screen 74 to another home screen 70 as represented by the directional line 78 in FIG. 7. While the item may simply be moved from one home screen to another, the item may also be copied such that the item subsequently appears in both of the home screens, that is, both the home screen from which the item was moved and the home screen to which the item was moved, as also shown, for example in FIG. 7.

As described above, an item may be moved between home screens that exist at the time that the canvas overview 80 was presented. However, the apparatus 10 of one embodiment may facilitate the creation of a new home screen. In this regard, the canvas overview 80 may include a portion that is initially blank, such as by being void of any items, such as the lower left portion of the canvas overview of FIG. 8. This portion of the canvas overview 80 may represent a new home screen that may be created by a user while viewing and interacting with the canvas overview. In order to create the new home screen, the apparatus, such as the processor 12 of the apparatus 10 of FIG. 1, and, in the embodiment in which the apparatus is embodied by a mobile terminal 20, the processor 28 of the mobile terminal, may be specifically configured to cause an item to be moved from one of the home screens to the initially blank portion of the canvas overview 80, such as the portion of the canvas overview that is designated for the construction of a new home screen, in order to newly define a different home screen. While the item may be moved in various manners, the item may be moved in the manner described above in which the item is highlighted, such as by placing a cursor upon the item, and then dragged to the portion of the canvas overview 80 that represents the new home screen. As described above in conjunction with the movement of items between existing home screens, the item that is moved from one home screen to a new home screen may be simply moved or may be copied such that the item subsequently appears in both the original home screen and the newly defined home screen.

By receiving the sequential selection of a number of different items from one or more of the home screens represented by the canvas overview 80 and recognizing the movement of items to the portion of the canvas overview that represents the newly defined home screen, a user may efficiently create a new home screen based upon any combination of the items presented in any of the other home screens. With reference to FIG. 8, for example, a new home screen may be created by movement of the photos application and the camera application from home screens 74 and 70, respectively, as indicated by the directional lines 82. In addition to or instead of items moved from other preexisting home screens, a newly defined home screen may include one or more items that are not currently included in any of the other home screens, thereby further differentiating the newly defined home screen from the other home screens.

As shown in operations 58, 60 and 62 of FIG. 3 and as illustrated in FIG. 9, the canvas overview that is presented may also include respective areas that are distinct from the plurality of home screens that comprise the canvas overview 80 in which the active applications, the shortcuts, the widgets, the application library or the like may be collected and displayed. As such, the apparatus, such as the processor 12 of the apparatus 10 of FIG. 1, or, in an embodiment in which the apparatus is embodied by a mobile terminal 20, the processor 28 of the mobile terminal of FIG. 2, may cause item(s), such as icon(s), representing each application that is active to be displayed in a respective area 84 of the canvas overview 80. Additionally or alternatively, the apparatus, such as the processor 12 of the apparatus 10 of FIG. 1, or, in an embodiment in which the apparatus is embodied by a mobile terminal 20, the processor 28 of the mobile terminal of FIG. 2, may cause item(s), such as icon(s), representing each shortcut, such as a shortcut to an application, function, content or the like, to be displayed in a respective area 86 of the canvas overview 80. Additionally or alternatively, the apparatus, such as the processor 12 of the apparatus 10 of FIG. 1, or, in an embodiment in which the apparatus is embodied by a mobile terminal 20, the processor 28 of the mobile terminal of FIG. 2, may cause an item 88, such as an icon or link, representing an application library to be displayed in a respective area of the canvas overview 80. Upon selection of the item representative of the application library, the contents of the application library, such as a listing of all available applications my be presented.

By collecting each of the active applications, shortcuts, widgets, application library or the like, in respective areas of the canvas overview 80, a user may readily select from among any of the active applications, any of the widgets, any of the shortcuts or any application that is included within the application library in order to launch the respective application, widget, function associated with the shortcut or the like regardless of the home screen, if any, on which an item representative of the application, widget, shortcut or the like otherwise appears. Thus, the canvas overview 80 of this embodiment that includes respective areas for the active applications, widgets, shortcuts, application library or the like may further increase the efficiency with which a user may interact with the various items of the plurality of home screens, particularly while the canvas overview 80 is displayed.

While the canvas overview 80 is presented, the apparatus 10 may be specifically configured to cause an application to be launched in response to user input. In this regard, the apparatus, such as the processor 12 of the apparatus 10 of FIG. 1, or, in an embodiment in which the apparatus is embodied by a mobile terminal 20, the processor 28 of the mobile terminal of FIG. 2, may cause an application to be launched, thereby facilitating task switching from the canvas overview 80. In this regard, any of the applications for which corresponding items are included in any of the home screens or that are otherwise included in the respective designated areas of the canvas overview 80 may be selected, such as by placement of a cursor upon or other highlighting of the respective item corresponding to the application. Once the application has been selected by a user, the apparatus 10, such as the processor 12, may cause the application to be launched, thereby facilitating task switching from a prior application to the newly selected application. As such, task switching may be provided in accordance with an example embodiment to the present invention in a manner that is intuitive and may be efficiently performed by a user, such as while the user is considering the canvas overview 80 and otherwise managing or modifying the home screens.

Accordingly, the method, apparatus and computer program product of an example embodiment of the present invention facilitate the management of a plurality of home screens including the redefinition of an existing home screen, the creation of a new home screen or the like. Additionally, the method, apparatus and computer program product of an example embodiment may facilitate task switching and/or access to an application library, thereby further facilitating user navigation between and among a plurality of applications, widgets, content, functions or the like in an efficient manner.

In an example embodiment, an apparatus for performing the method of FIG. 3 above may comprise a processor (e.g., the processor 12 or 28) configured to perform some or each of the operations (50-68) described above. The processor 12, 28 may, for example, be configured to perform the operations (50-68) by performing hardware implemented logical functions, executing stored instructions, or executing algorithms for performing each of the operations. Alternatively, the apparatus may comprise means for performing each of the operations described above. In this regard, the processor 12, 28 and/or a device or circuitry for executing instructions or executing an algorithm for processing information as described above may also form example means for performing operations 50-68.

As described above, FIG. 3 illustrates a flowchart of an apparatus, method, and computer program product according to an example embodiment. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by one or more memory devices of an apparatus, such as a mobile terminal (for example, in the memory device 18 of the apparatus 10 of FIG. 1 or the volatile or non-volatile memory 42, 44 of the mobile terminal 20 of FIG. 2) and executed by a processor (for example, by the processor 12 of the apparatus 10 of FIG. 1 or the processor 28 of the mobile terminal 20 of FIG. 2). In some embodiments, the computer program instructions comprising the computer program product(s) which embody the procedures described above may be stored by memory devices of a plurality of computing devices. As will be appreciated, any such computer program product may be loaded onto a computer or other programmable apparatus (for example, an apparatus 10) to produce a machine, such that the computer program product including the instructions which execute on the computer or other programmable apparatus creates means for implementing the functions specified in the flowchart block(s). Further, the computer program product may comprise one or more computer-readable memories on which the computer program instructions may be stored such that the one or more computer-readable memories can direct a computer or other programmable apparatus to function in a particular manner, such that the computer program product comprises an article of manufacture which implements the function specified in the flowchart block(s). The computer program instructions of one or more computer program products may also be loaded onto a computer or other programmable apparatus (for example, an apparatus 10) to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions. It will also be understood that one or more blocks of the flowchart, and combinations of blocks in the flowchart, may be implemented by special purpose hardware-based computer systems which perform the specified functions, or combinations of special purpose hardware and computer program product(s).

The above described functions may be carried out in many ways. As described above, for example, any suitable means for carrying out each of the functions described above may be employed to carry out embodiments of the invention. In one embodiment, a suitably configured processor (for example, the processor 12 or 28) may provide all or a portion of the elements. In another embodiment, all or a portion of the elements may be configured by and operate under control of a computer program product. The computer program product for performing the methods of an example embodiment of the invention includes a computer-readable storage medium (for example, the memory device 18, 42 or 44), such as the non-volatile storage medium, and computer-readable program code portions, such as a series of computer instructions, embodied in the computer-readable storage medium.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A method comprising:

causing a display of a first home screen;

causing, with a processor, the display to zoom out from the first home screen to a canvas overview representing a plurality of home screens including the first home screen, wherein the canvas overview is configured to present the plurality of home screens in a continuous arrangement without visible delineation or demarcation between the plurality of home screens and to group items accessible via a respective home screen in proximity to one another;

causing an item to be moved from one home screen to another portion of the canvas overview designated for creating a new home screen and not associated with an existing one of the plurality of home screens;

in response to the movement of the item from one home screen to the another portion of the canvas overview designated for creating the new home screen and determining the item is to be moved to the another portion of the canvas overview, causing creation of the new home screen;

causing an application associated with the item to launch in response to the item being selected; and facilitating switching from a prior active application to the launched application from the canvas overview.

2. A method according to claim 1 further comprising causing an item to be moved from one home screen to another home screen while the canvas overview is caused to be displayed.

3. A method according to claim 1 further comprising causing a representation of at least one application that is active to be displayed in a respective area of the canvas overview.

4. A method according to claim 1 further comprising causing a representation of each item representative of a shortcut to be displayed in a respective area of the canvas overview.

5. A method according to claim 1 further comprising causing an application library to be displayed in a respective area of the canvas overview.

6. An apparatus comprising at least one processor and at least one memory storing computer program code, wherein the at least one memory and stored computer program code are configured, with the at least one processor, to cause the apparatus to at least:

cause a display of a first home screen;

cause the display to zoom out from the first home screen to a canvas overview representing a plurality of home screens including the first home screen, wherein the canvas overview is configured to present the plurality of home screens in a continuous arrangement without visible delineation or demarcation between the plurality of home screens and to group items accessible via a respective home screen in proximity to one another;

cause an item to be moved from one home screen to another portion of the canvas overview designated for creating a new home screen;

in response to the movement of the item from one home screen to the another portion of the canvas overview designated for creating the new home screen and determining the item is to be moved to the another portion of the canvas overview, cause creation of the new home screen;

cause an application associated with the item to launch in response to the item being selected; and facilitate switching from a prior active application to the launched application from the canvas overview.

7. An apparatus according to claim 6 wherein the at least one memory and stored computer program code are further configured, with the at least one processor, to cause the apparatus to cause an item to be moved from one home screen to another home screen while the canvas overview is caused to be displayed.

8. An apparatus according to claim 6 wherein the at least one memory and stored computer program code are further configured, with the at least one processor, to cause the apparatus to cause a representation of at least one application that is active to be displayed in a respective area of the canvas overview.

9. An apparatus according to claim 6 wherein the at least one memory and stored computer program code are further configured, with the at least one processor, to cause the apparatus to cause a representation of each item representative of a shortcut to be displayed in a respective area of the canvas overview.

10. An apparatus according to claim 6 wherein the at least one memory and stored computer program code are further configured, with the at least one processor, to cause the apparatus to cause an application library to be displayed in a respective area of the canvas overview.

11. A computer program product comprising at least one non-transitory computer-readable storage medium having computer-readable program instructions stored therein, the computer-readable program instructions comprising:

program instructions configured to cause a display of a first home screen;

program instructions configured to cause the display to zoom out from the first home screen to a canvas overview representing a plurality of home screens including the first home screen, wherein the canvas overview is configured to present the plurality of home screens in a continuous arrangement without visible delineation or demarcation between the plurality of home screens and to group items accessible via a respective home screen in proximity to one another;

program instructions configured to cause an item to be moved from one home screen to another portion of the canvas overview designated for creating a new home screen;

program instructions configured to, in response to the movement of the item from one home screen to the another portion of the canvas overview designated for creating the new home screen and determining the item is to be moved to the another portion of the canvas overview, cause creation of the new home screen;

program instructions configured to cause an application associated with the item to launch in response to the item being selected; and program instructions configured to facilitate switching from a prior active application to the launched application from the canvas overview.

12. A computer program product according to claim 11 wherein the computer-readable program instructions further comprise program instructions configured to cause an item to be moved from one home screen to another home screen while the canvas overview is caused to be displayed.

13. A computer program product according to claim 11 wherein the computer-readable program instructions further comprise program instructions configured to cause a representation of at least one application that is active to be displayed in a respective area of the canvas overview.

14. A computer program product according to claim 11 wherein the computer-readable program instructions further comprise program instructions configured to cause a representation of each item representative of a shortcut to be displayed in a respective area of the canvas overview.

15. A computer program product according to claim 11 wherein the computer-readable program instructions further comprise program instructions configured to cause an application library to be displayed in a respective area of the canvas overview.

* * * * *